US005700168A

United States Patent [19]

Mondek et al.

[11] Patent Number: 5,700,168

[45] Date of Patent: Dec. 23, 1997

[54] ELECTRONIC IGNITION INTERRUPTION APPARATUS

[75] Inventors: Martin J. Mondek, Wonder Lake; James C. Kantola, Waukegan, both of Ill.

[73] Assignee: Outboard Marine Corporation, Waukegan, Ill.

[21] Appl. No.: 697,061

[22] Filed: Aug. 19, 1996

[51] Int. Cl.[6] ..... B63H 23/08

[52] U.S. Cl. ..... 440/1; 440/86; 477/101

[58] Field of Search ..... 440/1, 86; 477/101, 477/103

[56] References Cited

U.S. PATENT DOCUMENTS

| | | | |
|---|---|---|---|
| Re. 32,998 | 7/1989 | Davis . | |
| 2,297,676 | 10/1942 | Elkin . | |
| 3,481,223 | 12/1969 | Fraser . | |
| 3,894,250 | 7/1975 | Hager et al. . | |
| 3,910,388 | 10/1975 | Moori et al. . | |
| 4,072,204 | 2/1978 | Leighton et al. . | |
| 4,215,596 | 8/1980 | Long . | |
| 4,262,622 | 4/1981 | Dretzka et al. . | |
| 4,403,970 | 9/1983 | Dretzka et al. . | |
| 4,432,734 | 2/1984 | Bland et al. . | |
| 4,525,149 | 6/1985 | Broughton et al. . | |
| 4,753,618 | 6/1988 | Entringer . | |
| 4,838,822 | 6/1989 | Friedle et al. . | |
| 4,973,274 | 11/1990 | Hirukawa | 440/1 |
| 5,072,629 | 12/1991 | Hirukawa et al. | 477/101 |

*Primary Examiner*—Sherman Basinger
*Attorney, Agent, or Firm*—Jones, Day, Reavis & Pogue

[57] ABSTRACT

A shift interrupt apparatus for a marine drive of the type which has an ignition system and a transmission that is adapted to be selectively shifted among forward, neutral and reverse operating positions. A control member is provided for selectively positioning the transmission of the drive into forward, neutral and reverse operating positions. The apparatus has a light circuit associated with a mechanical assembly adapted to detect excessive shifting force, which generates an electrical signal for interrupting the ignition to facilitate easier shifting.

6 Claims, 2 Drawing Sheets

ELECTRONIC IGNITION INTERRUPTION APPARATUS

BACKGROUND OF THE INVENTION

This invention generally relates to marine propulsion devices, such as stern drive units and outboard motors, including a reversing transmission and a shifting mechanism therefore and, more particularly, to marine propulsion devices including means for assisting in transmission shifting.

It is well known that marine propulsion devices such as outboard motors and stem drive units employ reversing clutches or transmissions which connect the output shaft of an engine to the propeller shaft to provide forward drive, reverse drive, and neutral operations. These transmissions often include a pair of opposed axially spaced drive gears on a clutch dog which is splined to the propeller shaft and can be selectively shifted axially into engagement with the drive gears. Driving lugs on the clutch dog engage complimentary driving lugs on the drive gears. It is also well known that relatively high shift loads can be experienced when attempting to shift the transmission from either forward drive or reverse drive operations to the neutral operation. A torque exerted on the clutch dog lugs by the drive gear creates a resistance to movement of the clutch dog from an in gear position to neutral. Such shifting can be facilitated by momentarily interrupting the engine operation and thereby minimizing the torque.

There are many examples of prior arrangements which include such electrical control to interrupt engine operation for facilitating transmission shifting as disclosed in U.S. Pat. Nos. 4,432,734 and 4,838,822, both of which are assigned to the same assignee as the present invention.

SUMMARY OF THE INVENTION

While the aforementioned patents are operable in a marine propulsion device of the type which has an internal combustion engine and a reversible transmission for driving a propeller shaft in forward, reverse as well as a neutral position and has a shift assembly which includes a rotatable member for shifting the transmission between the three positions in response to rotation of a rotatable member of a shift lever and a means for interrupting the engine ignition in response to movement of the element relative to the shift lever as well as a shift assisting means which include an element adapted for movement by the operator to effect shifting and carried by the shift lever for common movement therewith and for movement relative to the shift lever when the shift resistance is greater than the predetermined level and means for interrupting the engine ignition in response to movement of the element relative to the shift lever, the structures have a relatively large number of parts.

Accordingly, it is a primary object of the present invention to provide an improved ignition interrupting means that is operable in response to the movement of a shift lever which is connected to an operator control which is simple in its design and operation.

Another object of the present invention is to provide an ignition interrupting means which utilizes a light circuit to detect the presence of excessive biasing force on the shifting mechanism for the purpose of interrupting the ignition of the motor. An ancillary object is the elimination of a mechanical switch that is present in known prior art ignition interruption mechanisms.

Other objects and advantages will become apparent to those skilled in the art upon reviewing the following detailed description, while referring to the attached drawings, in which.

DETAILED DESCRIPTION

The present invention is directed to a shift interrupt apparatus for a marine drive of the type which has an ignition system and the transmission that is adapted to be selectively shifted among forward, neutral and reverse operating positions. The invention is described for use in an outboard motor, but it should be understood that the invention is adapted for use in a stem drive unit as well as other marine propulsion devices. The shift interrupt apparatus includes a radiation or light circuit, preferably infrared radiation, which is used to interrupt the motor operation when an operator attempts to shift the motor transmission between two of its forward, neutral and reverse operating positions when excessive torque exists when a shifting operation is attempted.

Figure 1:
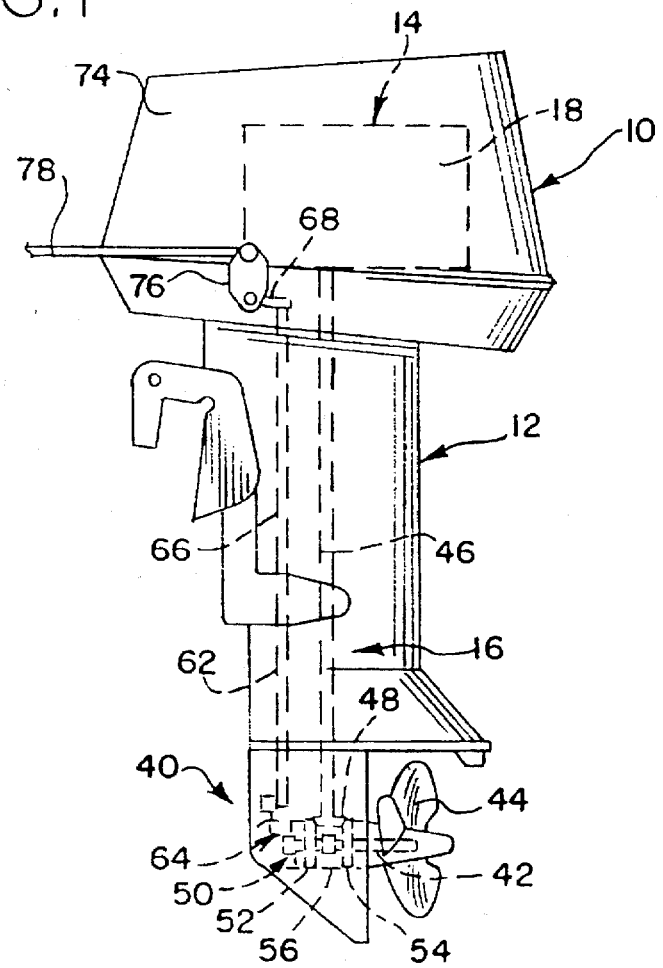
FIG. 1 is a side elevation of an outboard motor embodying the present invention.
Figure 2:
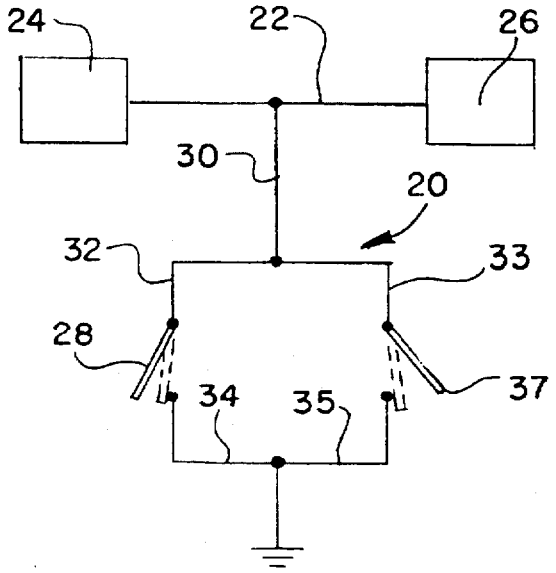
FIG. 2 is a diagrammatic representation of the ignition interruption circuit included in the outboard motor shown in FIG. 1.

Turning now to the drawings, and particularly FIG. 1, an outboard motor 10 is shown having a propulsion unit 12, including a power head 14 and a lower unit 16. The power head 14 includes a conventional internal combustion engine 18 having a suitable ignition system of conventional construction which is shown diagrammatically in FIG. 2.

The engine ignition circuit includes an electrical lead for connecting to an electric power supply 24 which is a flywheel magneto, to the engine spark plugs 26 and an on/off switch 28 between the supply lead 22 and the engine ground via electrical leads 30, 32 and 34. The ignition switch is moved between an on or engine operating position illustrated by the solid line in FIG. 2 to permit flow of electric current to the spark plugs 26 and in an off position as illustrated by the dashed line in FIG. 2 to ground or short out the power supply 24 via leads 30, 32 and 34, thereby interrupting current flow through the spark plugs. In accordance with the present invention, the power supply 24 can be shorted to ground via leads 30, 33 and 35 in combination with switch 37 that is controlled by the shift lever assembly.

The lower unit 16 includes a gear case 40 which has a rotatable propeller shaft 42 carrying a propeller 44. A drive shaft 46 which is operably connected at the upper end to the engine 18 carries a bevel drive gear 48 on the lower end. The drive shaft is connected to the propeller shaft through a conventional reversing clutch or transmission 50. The transmission 50 includes a pair of axially spaced beveled gears 52 and 54 which are mounted for rotation coaxially with and independently of the propeller shaft 42 and mesh with the drive gear 48. The transmission also includes a shiftable clutch dog 56 which is caried on the propeller shaft 42 between the bevel gears 52 and 54 as is conventional. The clutch dog 56 is moved among reverse, forward and neutral positions by a conventional lower shift mechanism indicated generally at 62 which includes a shift actuator 64 operatively connected to the clutch dog for a common axial movement therewith while affording rotation of the propeller shaft 42 relative to the clutch dog 56 and the shift actuator 64. The shift mechanism 62 also includes a control or actuating rod 66 supported in the propulsion unit 12 for a reciprocal movement transversely of the propeller shaft 42. The lower end of the actuating rod 66 is operatively connected to the shift actuator 64 to effect actual movement of the shift actuator 64 and the clutch dog 56 relative to the propeller shaft 42 in response to movement of the actuating rod 66 transversely of the propeller shaft.

The upper end of the actuating rod 66 is pivotally connected to an arm 68 mounted on a rotatably supported shift control shaft 70 (see FIGS. 3 and 4) having an outer end portion 72. The outer end portion 72 of the shift control shaft and the arm 68 can be located exteriorly of the power head cover 74 as illustrated or it can be located inside of the power head cover 74 if desired. Rotation of the shift control shaft produces reciprocal movement of the actuating rod 66 to shift the transmission 62 among forward drive, reverse drive, and neutral positions.

The shift control shaft 70 is rotated to shift the transmission 50 via a shift lever assembly indicated generally at 76 that is connected to a main control lever (not shown) by means of a push-pull control cable assembly 78 connected to the upper end thereof. The shift lever assembly 76 rotates in opposite directions around shaft 70 in response to movement of the push-pull cable assembly 78 being moved as a result of operation of the main control lever by the operator.

Because relatively high shift loads can be experienced when attempting to shift the transmission 50 from either the forward drive or the reverse drive to the neutral positions at speeds higher than idle speed, the present invention momentarily interrupts engine ignition in response to movement of the shift lever assembly from either the forward drive position or the reverse drive position to the neutral position when the shift resistance exceeds a predetermined level, thereby reducing the excessive torque and facilitating easier axial movement of the transmission from an in-gear position to the neutral position.

The shift lever assembly 76 is adapted to be responsive to excessive torque when such shifting is attempted and the responsive movement is then detected by the present invention which then interrupts the ignition to reduce the torque applied. More particularly, the shift lever assembly 76 includes a shift lever 80 which comprises a generally flat plate that is securely attached to the shaft 70 by a weldment 83 or the like, and the lever 80 has an opening 81 which is generally rectangular and is comprised of vertical side portions 82 and a semi-circular portion 84 which extends to the vertical side portions 82 by ramp portions 86. The cable assembly 78 is pivotally attached to a pin 88 which has enlarged end portions 90 and 92, and a reduced diameter portion 94 which fits within the opening 84. The pin has another reduced diameter portion 96 that extends beyond the enlarged end portion 92 to which an end fitting 98 is provided for connecting the cable assembly.

The shift lever assembly 76 also includes a slider element 100 which has an internal recess 102 (see FIG. 4) for receiving a spring 104, the other end of which is retained in a recess 106 of a stationary retainer 108 that fits within the opening 81. The slider element 100 also has an upper extension 110 that is in contact with the pin 88. By virtue of the spring force, the pin is held in the upper end 84 of the opening 81.

Figure 3:
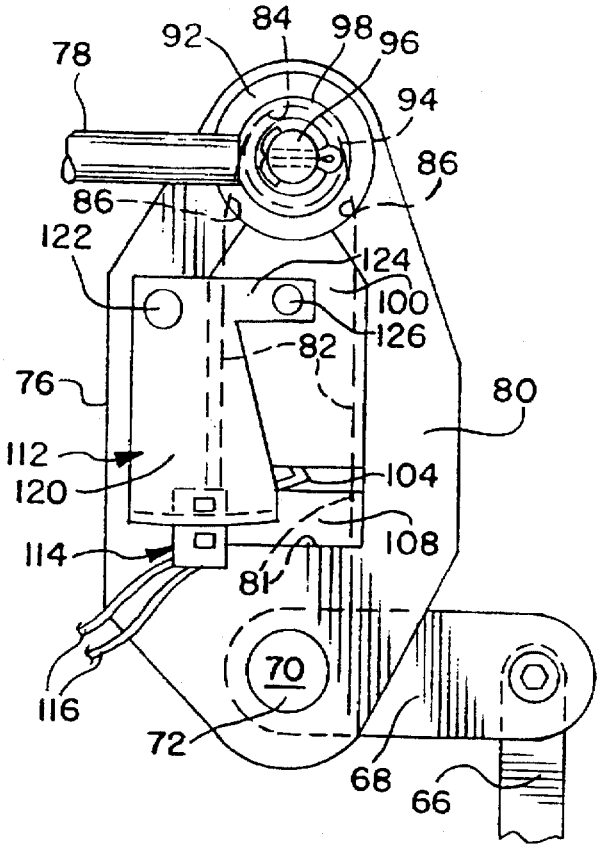
FIG. 3 is an enlarged fragmentary side elevation of the shift lever and associated components for shifting the transmission of the outboard motor shown in FIG. 1, and incorporating the present invention.
Figure 4:
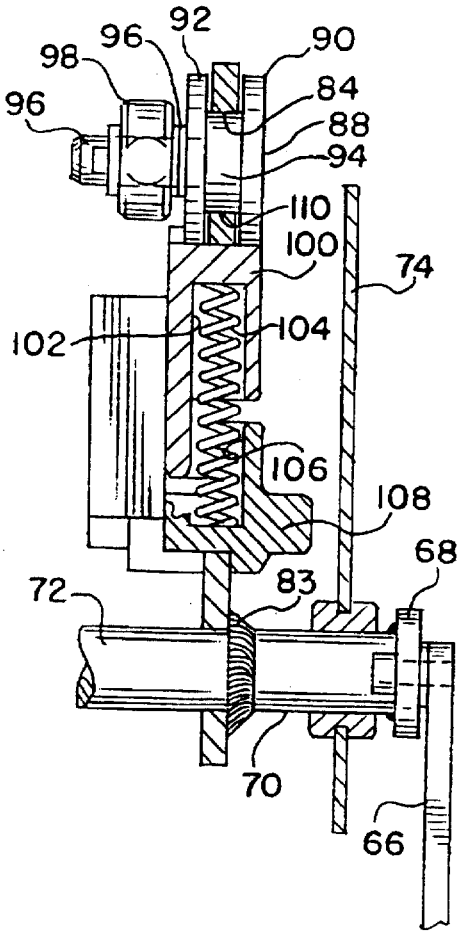
FIG. 4 is a partially sectioned, end view of the shift lever and associated components shown in FIG. 2.

During a shifting operation, if the cable assembly is moved either left or right as shown in FIG. 3 and the torque encountered which resists the shifting operation is greater than the spring force supplied by the spring 104, then the pin 90 will move down the ramp portion 86 of the opening 81 and cause the slider element 100 to move downwardly toward the retainer element 108. It should be appreciated that during shifting, if there is no extraordinary resistance to the shifting operation so that the forces generated between the cable assembly and the lever 80 do not exceed the spring force applied to the slider element holding the pin 88 in the upper end 84 of the opening 82, the slider element 100 will not move.

In accordance with an important aspect of the present invention, movement of the slider element is detected so that the ignition can be temporarily cut out to reduce the force being applied to the shift lever assembly 76. To this end, an encoder assembly, indicated generally at 112, and a detector, indicated generally at 114, are provided to provide an electrical signal on lines 116 which extend to the ignition circuitry for the purpose of cutting out the ignition for as long as the slider element 100 is displaced from its normal upward position.

Figure 5:
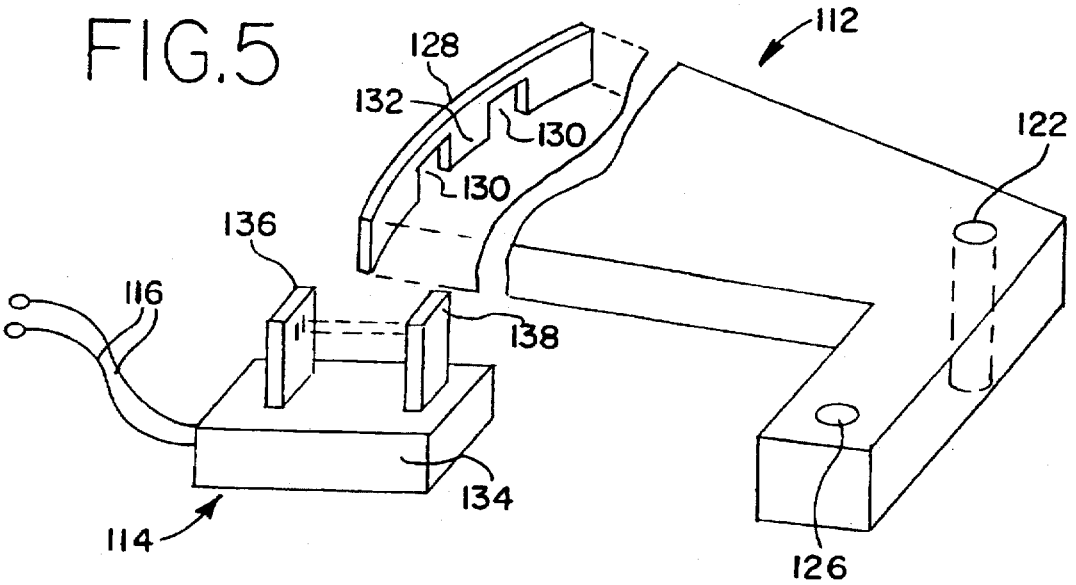
FIG. 5 is a perspective view, partially broken away, and illustrating electronic shift interrupt apparatus embodying the present invention.

The encoder assembly 112 has a main portion 120 that has its upper end pivotally attached to the lever 80 by a pin 122 or the like and has a lateral extension 124 that is pivotally attached to the slider 100 by a pin 126. Thus, it can be seen that when the slider 100 moves down, the lower end of the encoder assembly will be moved to the left as the slider assembly is moved down. Referring to FIG. 5, the left (lower) end of the assembly 112 has a end wall 128 in which a pair of openings 130 are located with a wall portion 132 being positioned therebetween. The detector 114 has a base portion 134, an emitter portion 136 and a detector portion 138 in spaced relation from each other in position to emit and detect the presence or absence of the emitted beam during operation. The base portion 134 of the detector 114 is attached to the lever 80 by a suitable attachment means such as screws, adhesive, clamping means or the like. The emitter 136 is preferably an infrared emitter/detector pair and the emitter/detector pair are located on opposite sides of the wall 128. Depending upon engineering choice, the beam can normally be positioned relative to the wall portion 132 blocking the beam or it can be in one of the openings 130 so that the beam is continuously being detected during operation. Once the slide element is moved downwardly, the encoder assembly is pivoted so that the wall 128 will be moved relative to the detector 114 and will either make or break the detected beam and generate a signal in lines 116 for initiating interruption of the ignition system.

From the foregoing description, it should be appreciated that an improved shift interrupt apparatus has been shown and described which utilizes simple available inexpensive electrical elements which can be easily installed and which results in reliable operation.

While various embodiments of the present invention have been shown and described, it should be understood that various alternatives, substitutions and equivalents can be used, and the present invention should only be limited by the claims and equivalents of the claims.

Various features of the present invention are set forth in the following claims.

What is claimed is:

1. In a marine propulsion device including an internal combustion engine, a propulsion unit, a propeller shaft rotatably mounted in said propulsion unit and carrying a propeller, a drive shaft rotatably mounted in said propulsion unit and driven by said internal combustion engine, a transmission drivingly connecting said drive shaft with said propeller shaft and movable between forward drive, reverse drive and neutral positions, shift means including a rotatable member operably connected to said transmission for moving said transmission between the forward drive, reverse drive and neutral positions in response to rotation of said member, said shift means further including a shift lever mounted on said rotatable member for rotation in common therewith, and shift assistance means including an element adapted for movement by an operator to effect shifting and carried by said shift lever for common movement therewith and for translatory movement relative to said shift lever when shift resistance to movement of said transmission from either the forward drive position or the reverse drive position to the neutral position is greater than a predetermined level, the improvement comprising interruption means for interrupting engine ignition in response to movement of said element relative to said shift lever, said interruption means including an encoder and a detector, said encoder being movably mounted on said shift lever and connected to said element for movement in response to translatory movement of said element relative to the shift lever, said detector being mounted on said shift lever and adapted to generate a signal in response to movement of said encoder for interrupting engine ignition.

2. The improvement according to claim 1 wherein said detector includes an emitter for generating an electronic beam and a detection element for sensing the presence and absence of the beam, and wherein said encoder includes means for interrupting the beam in response to movement of the encoder relative to the shift lever.

3. The improvement according to claim 2 wherein said beam is an infrared beam.

4. The improvement according to claim 1 further defined by, said encoder being pivotally mounted on said shift lever and pivotally connected with said element, said detector being fixedly mounted on said shift lever.

5. The improvement according to claim 6 wherein said detector includes an emitter for generating an electronic beam and a detection element for sensing the presence and absence of the beam, and wherein said encoder includes means for interrupting the beam in response to movement of the encoder relative to the shift lever.

6. The improvement according to claim 5 wherein said beam is an infrared beam.

* * * * *